US006095046A

United States Patent [19]

Lookholder et al.

[11] Patent Number: 6,095,046

[45] Date of Patent: Aug. 1, 2000

[54] STAMPING DEVICE HAVING TRANSPARENT MOUNTING BLOCK AND IMPRINTING ELEMENT

[75] Inventors: Dale Lookholder, Santa Clarita; Christopher B. Caston, Glendale; Joaquin G. Serrano; Theodore Lookholder, both of Los Angeles, all of Calif.

[73] Assignee: Glendale Rubber Stamp & Printing, Co., Glendale, Calif.

[21] Appl. No.: 09/353,115

[22] Filed: Jul. 14, 1999

[51] Int. Cl.[7] ..... B41K 1/56

[52] U.S. Cl. ..... 101/405; 101/327; 101/368

[58] Field of Search ..... 101/405, 406, 101/327, 328, 333, 109, 401, 368, 375

[56] References Cited

U.S. PATENT DOCUMENTS

| | | | |
|---|---|---|---|
| 2,819,668 | 1/1958 | McAneny | 101/405 |
| 2,970,539 | 2/1961 | Griffin | 101/368 |
| 3,259,063 | 7/1966 | Rothman | 101/405 |
| 3,973,495 | 8/1976 | Rowe | 101/405 |
| 5,191,837 | 3/1993 | Bolton | 101/406 |
| 5,313,885 | 5/1994 | Winston | 101/405 |
| 5,642,667 | 7/1997 | Sastre | 101/405 |
| 5,857,411 | 1/1999 | Carsel | 101/333 |
| 5,909,709 | 6/1999 | An et al. | 101/405 |

FOREIGN PATENT DOCUMENTS

| | | | |
|---|---|---|---|
| 2 045 687 | 11/1980 | United Kingdom | 101/405 |

*Primary Examiner*—John S. Hilten
*Assistant Examiner*—Leslie J. Grohusky
*Attorney, Agent, or Firm*—James E. Brunton

[57] ABSTRACT

A hand-held stamping device that includes a substantially transparent acrylic mounting block to which a substantially transparent printing element is removably affixed. When the device of the invention is used, the indicia formed on the printing element can be clearly viewed through the mounting block, and the printing surface can be clearly viewed through the printing element. This enables precise positioning of the indicia on the surface to be printed. The device includes both a convex surface and a planar surface to which the printing element can be removably affixed. When the printing element is affixed to the planar surface the indicia on the printing element, when viewed through the convex surface, is magnified.

7 Claims, 3 Drawing Sheets

STAMPING DEVICE HAVING TRANSPARENT MOUNTING BLOCK AND IMPRINTING ELEMENT

BACKGROUND OF THE INVENTION

1. Field of the Invention

The present invention relates generally to hand stamping devices. More particularly, the invention concerns a novel hand stamping apparatus having a substantially transparent, hand-held mounting block to which a substantially transparent printing element or die can be removably affixed. In using the device the printing element can be clearly viewed through the transparent mounting block and the surface to be imprinted can be viewed through the printing element so that the indicia formed on the printing element can be precisely positioned relative to the surface to be imprinted.

2. Discussion of the Invention

Hand stamp devices of many different configurations have been suggested in the past. The classic hand stamp comprises a rubber stamp die that is fixedly mounted on a wooden block to which a bulb shaped wooden handle is attached. Such hand stamps are traditionally used with an ink pad which applies ink to the indicia formed on the die prior to each stamping operation. The printing element or pattern bearing surface is typically made of rubber.

In recent years a number of different types of hand stamps having elaborate pattern-bearing, ink-receiving surfaces have been suggested. These types of hand stamps may be used to print a wide variety of decorative images on envelopes, stationery and the like. However, because the pattern-bearing surface cannot be seen through the stamp supporting block or handle it is virtually impossible to precisely position the pattern on the surface to be imprinted. Similarly, prior art hand stamp devices having indicia in the form of legends such as words and numbers are difficult to use because the user cannot see the indicia and therefore cannot accurately position it on the surface to be imprinted.

The prior are ink stamp device disclosed in U.S. Pat. No. 5,642,667 issued to Sastre partially solves the stamp positioning problem discussed in the preceding paragraphs by providing a translucent handle and base through which the imprinting element is visible. However, because the imprinting element itself is not transparent, precise positioning of the indicia on the imprinting element remains difficult.

U.S. Pat. No. 3,973,495 issued to Rowe also discloses a hand stamp comprising a transparent base through which a proof of the impression is visible to the user. However, like the Sastre device, the printing element itself is not transparent.

The thrust of the present invention is to provide an improved hand-held ink stamp in which both the mounting block and the imprinting element that is affixed thereto are substantially transparent so that the indicia formed on the imprinting element can be seen clearly and precisely positioned on the surface to be imprinted.

Additionally, in one form of the present invention, the mounting block is uniquely formed so as to magnify the indicia formed on the imprinting element when viewed through the convex upper surface of the mounting block.

SUMMARY OF THE INVENTION

It is an object of the present invention to provide a novel hand stamp which is of an elegantly simple construction that includes a substantially transparent acrylic mounting block to which a substantially transparent printing element is removably affixed. With this construction, when the device is used, the indicia formed on the printing element can be clearly viewed through the mounting block, and the printing surface can be clearly viewed through the printing element.

Another object of the invention is to provide a hand stamp of the aforementioned character in which the sides of the mounting block are provided with finger gripping means so that the stamp can be conveniently gripped by the user.

Another object of the invention is to provide a hand stamp of the character described in the preceding paragraphs in which the mounting block includes a convex upper surface which magnifies the indicia formed on the printing element when the printing element is affixed to the lower planar surface of the mounting block.

Another object of the invention is to provide a hand stamp of the type described in the preceding paragraphs in which the substantially transparent printing element is formed from a photopolymer and is resiliently deformable so that it can be selectively affixed to either the convex surface or the planar surface of the mounting block.

Another object of the invention is to provide a hand stamp of the class described in which a plurality of substantially transparent individual printing elements can be removably affixed to either of the surfaces of the mounting block.

Another object of the invention is to provide a hand stamp of the character described in the preceding paragraphs in which the stamping element is bounded by an upstanding edge portion to which ink can be applied from an ink pad or the like.

DESCRIPTION OF THE INVENTION

Figure 1:
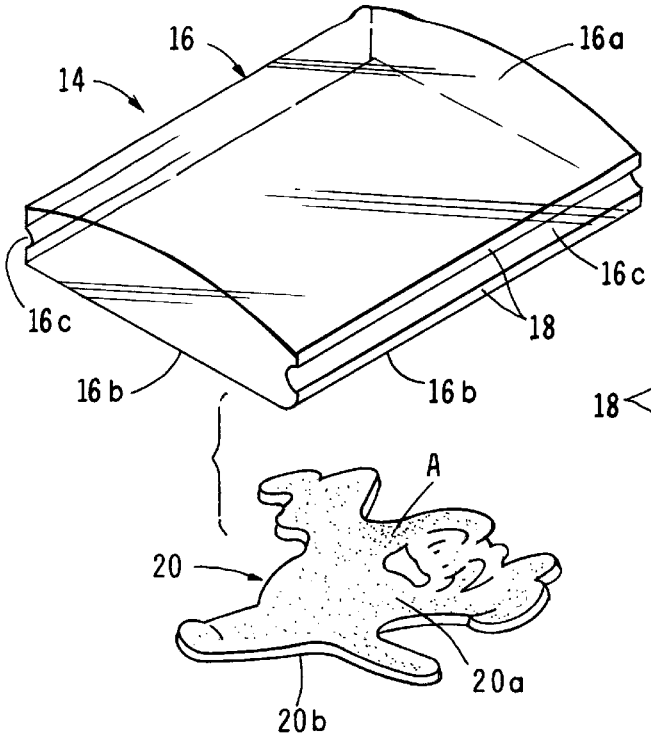
FIG. 1 is a generally perspective, exploded top view of one form of the hand stamp device of the invention.
Figure 2:
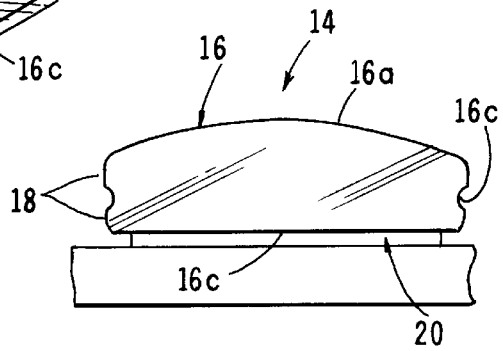
FIG. 2 is an end view of the device illustrated FIG. 1 and shown in engagement with the surface to be imprinted.
Figure 3:
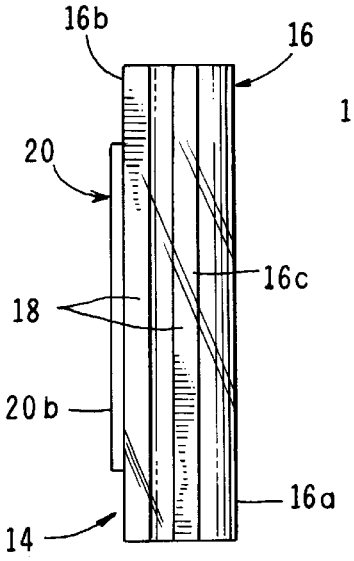
FIG. 3 is a side view of the device shown in FIG. 1.

Referring to the drawings and particularly FIGS. 1 through 3, one form of the stamping device of the invention is there illustrated and generally designated by the numeral 14. The device here comprises a substantially transparent, rigid, plastic mounting block 16 having a mirror polished convex top surface 16*a*, a generally planar mirror polished bottom surface 16*b*, and spaced-apart sides 16*c*. As best seen in FIGS. 1 and 2 each of the spaced-apart sides 16*c* is provided with gripping means shown here as finger gripping portions 18. Mounting block 16 can be formed of various plastics but a clear acrylic has proven satisfactory.

Figure 7:
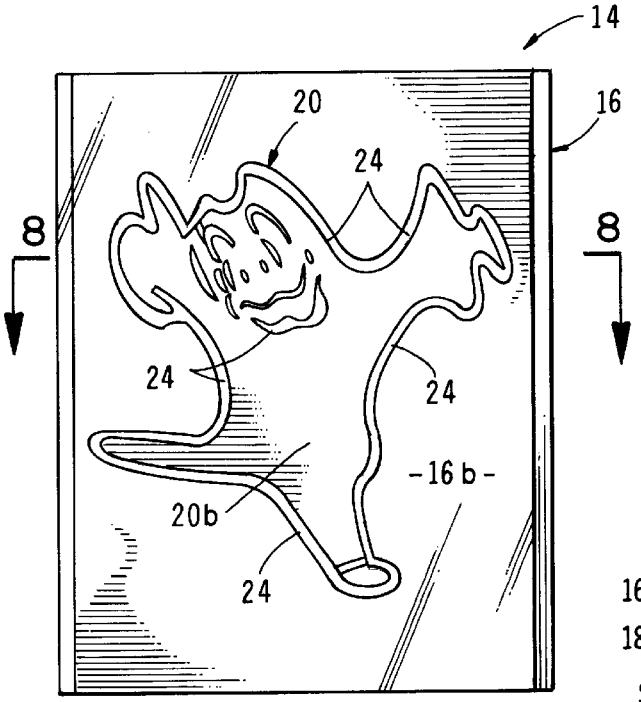
FIG. 7 is an enlarged bottom plan view of the form of the device shown in FIG. 1.
Figure 9:
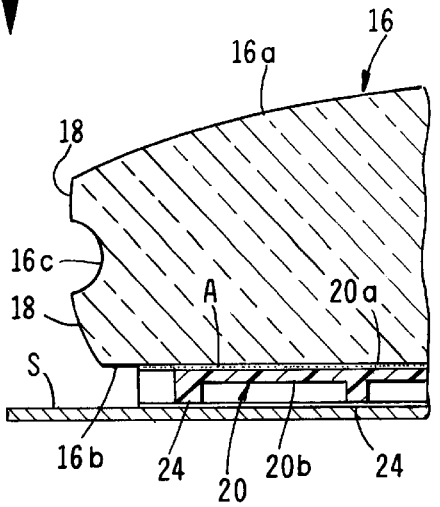
FIG. 9 is a greatly enlarged cross-sectional view of the area designated in FIG. 8 by the numeral 9.
Figure 8:
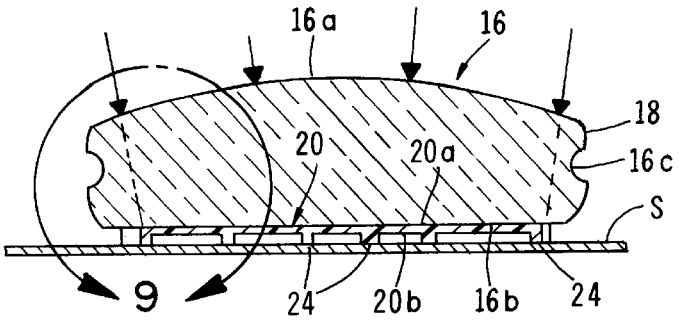
FIG. 8 is a cross-sectional view taken along lines 8—8 of FIG. 7.

In the form of the invention shown in FIGS. 1, 2, and 3, a substantially transparent imprinting element or die 20 is removably affixed to bottom surface 16*b* in the manner indicated in FIGS. 2 and 3. Imprinting element 20 is preferably formed of a photopolymer such as a liquid polyester that will polymerize when exposed to ultraviolet light. Element 20 is resiliently deformable and includes a generally planar, adhesive coated first side 20a and a spaced-apart second surface 20*b* (FIG. 1). As best seen by referring to FIGS. 8 and 9, second surface 20*b* is provided with upstanding ink receiving portions 24, which portions define the details of the stamped impression. As best seen by referring to FIG. 7, portions of the upstanding ink receiving portions, or ribs 24, circumscribe the periphery of the printing element and define the outer limits of the indicia that will be imprinted on the surface "S" which receives the inked impression (FIG. 9). Portions 24 can be inked using conventional ink pads containing conventional inks or water soluble inks. When water soluble inks are used, the ink will readily evaporate returning the printing element to its transparent condition.

Figure 10:
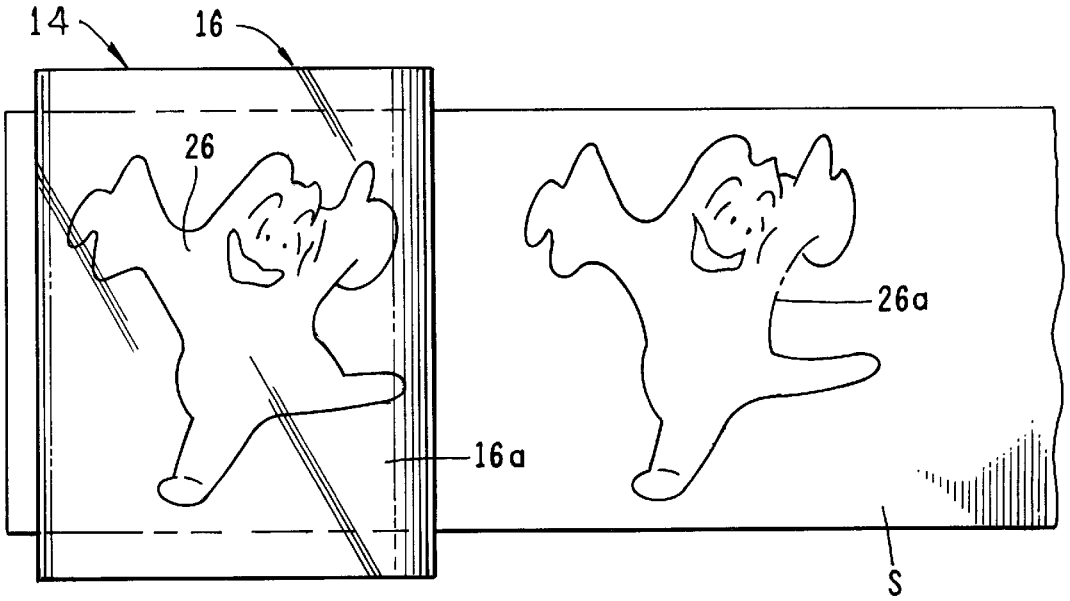
FIG. 10 is a generally diagrammatic view illustrating the magnifying capability of the device.

As depicted in FIG. 10, when an imprinting element, such as element 26, is affixed to the bottom surface 16*b* of the mounting block 16, the convex upper surface 16*a* of the mounting block 16 functions to magnify the image 26*a* which is imprinted on the imprinted surface "S". More particularly, as shown in FIG. 10, when the imprinted indicia, generally designated in FIG. 10 by the numeral 26, is viewed through the mounting block 16 as indicated in the left-hand portion of FIG. 10, the image to be imprinted will be somewhat magnified, that is larger in size than indicia 26*a*, to enable better viewing of the details of the stamped indicia. When the stamping element includes highly detailed decorative features, this aspect of the invention is very useful.

Figure 4:
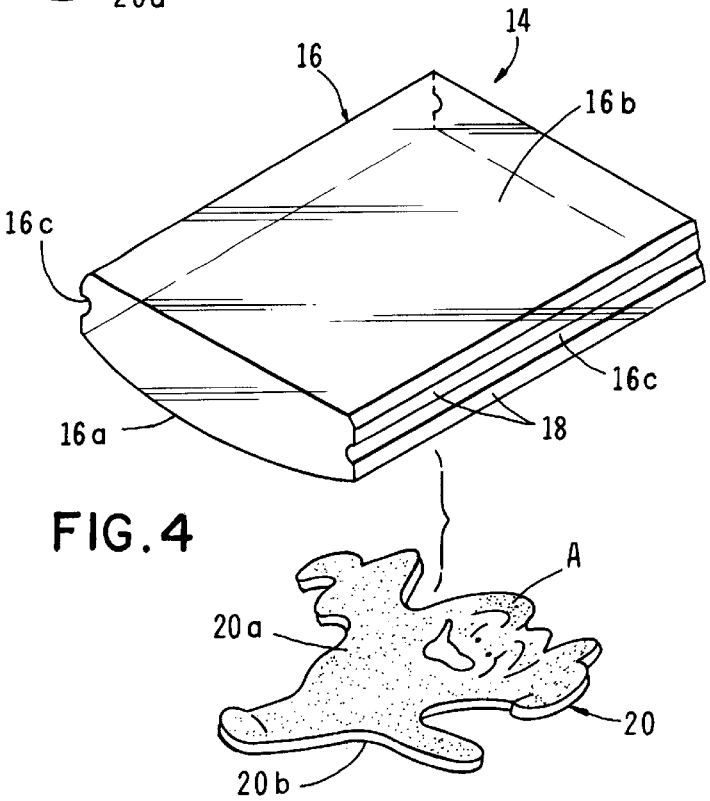
FIG. 4 is a generally perspective, exploded bottom view of the device of the invention showing the printing element removably affixed to the convex surface of the mounting block.
Figure 5:
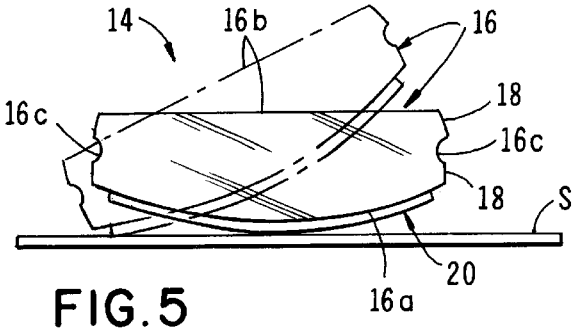
FIG. 5 is an end view of the device shown in FIG. 4 illustrating the manner of its use to imprint indicia onto a printing surface by means of a rocking motion.
Figure 6:
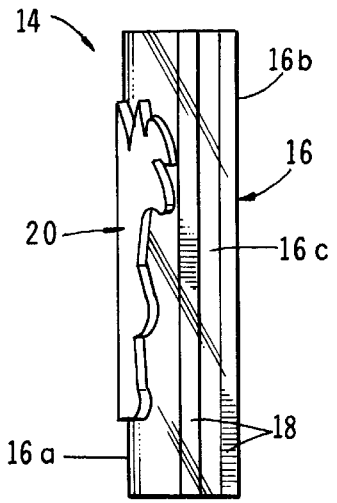
FIG. 6 is a side view of the device illustrated in FIGS. 4 and 5.

Turning next to FIGS. 4, 5 and 6, another highly novel feature of the present invention is there illustrated. More particularly, as illustrated in these figure drawings, the transparent imprinting element 20 can also be affixed to the convex upper surface 16*a* of the block so that the image can be imprinted onto the surface "S" by a rolling or rocking motion imparted to the mounting block in the manner illustrated in FIG. 5. Because of the resilient nature of the imprinting element 20, the element will smoothly conform to the convex surface 16*a* so as to produce a clear image such as image 26*a* on the printed surface "S".

Figure 11:
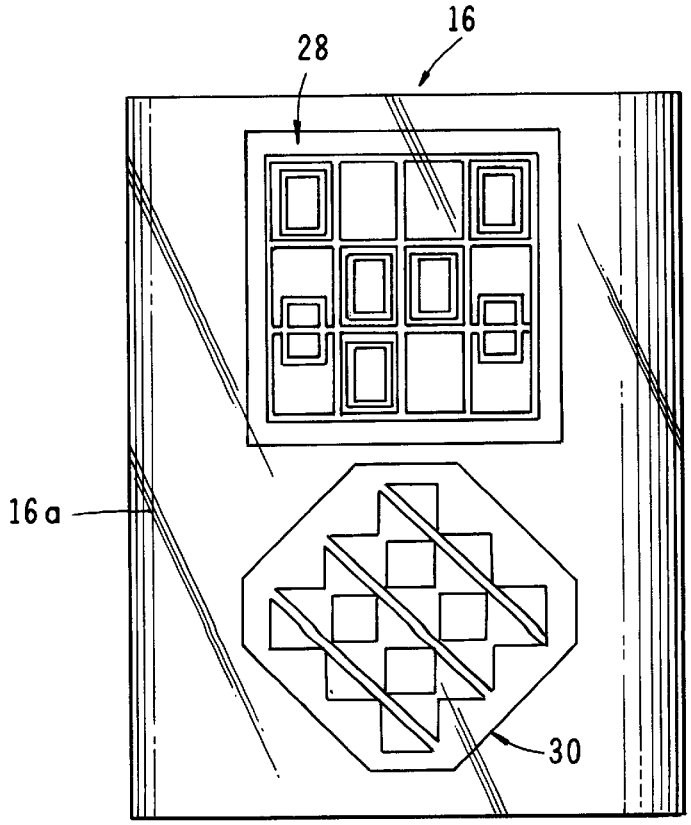
FIG. 11 is a plan view of an alternate form of the stamping device showing a plurality of dies affixed to the mounting block.

Referring next to FIG. 11, it is to be observed that a plurality of highly detailed imprinting elements, such as elements 28 and 30, can be removably affixed to either surface 16*a* or 16*b* of mounting block 16. As previously discussed, when the imprinting elements are removably affixed to generally planar surface 16*b*, the indicia provided on the imprinting elements will be magnified when viewed through the mounting block in the direction of the arrows of FIG. 7. Because the mounting block is substantially transparent as are each of the imprinting elements 20, 28, and 30, it is at once apparent that the images to be formed on the imprinted surface "S" can be clearly viewed and precisely located and arranged on the surface "S" with great ease. When the imprinting elements comprise legends such as numbers and letters, the ability to view the precise location of the legends on each of the stamps is extremely important and, for example, enables the legends to be precisely positioned over a line or between lines provided on the surface "S". Additionally, when intricate designs are formed on the imprinting element, such as those illustrated in FIG. 11, the precise location of the details of each image can be precisely positioned on the surface "S".

While the imprinting elements 20, 28 and 30 can be constructed of various materials, the aforementioned photopolymer material is preferred. Such material is readily commercially available from several sources such as The Louis Melind Company, Inc. of Skokie, Ill. and the printing elements themselves can be formed by ultraviolet curing in a manner well understood by those skilled in the art. Additionally, a suitable adhesive "A" (FIG. 1) can be applied to surface 20*a* in a manner well understood by those skilled in the art. Alternatively, the printing element can be constructed from a suitable polymer that exhibits viscoelastic characteristics that enables the printing element to be removably affixed to either the convex or planar surfaces of the mounting block without the use of an adhesive "A". These viscoelastic polymers in effect exhibit a multiplicity of very small suction-cup like protuberances which relasably grip the smooth surfaces of the mounting block.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A stamping device comprising:

(a) a substantially transparent, rigid mounting block having a top surface, a smooth bottom surface and spaced-apart sides; and (b) a substantially transparent, integral imprinting element removably affixed to one of said top and bottom surfaces, said imprinting element being formed of a viscoelastic photopolymer and having an upper surface and a lower surface, said lower surface having upstanding ink receiving portions viewable through said mounting block and said upper surface having a multiplicity of small gripping protuberances for gripping said smooth bottom surface of said mounting block.

2. The device as defined in claim 1 in which said top surface is convex.

3. The device as defined in claim 1 in which said spaced-apart sides include finger gripping portions.

4. A stamping device comprising:

(a) a substantially transparent, rigid mounting block having a convex smooth top surface, a generally planar, smooth bottom surface and spaced-apart sides, each said side having finger gripping means for gripping by the user; and (b) at least one substantially transparent, integrally formed imprinting element selectively removably affixed to one of said top and bottom surfaces, said imprinting element being formed of a viscoelastic photopolymer and having an upper surface and a lower surface, said lower surface having upstanding ink receiving portions viewable through said mounting block and said upper surface having a multiplicity of small gripping protuberances for gripping said smooth surfaces of said mounting block.

5. The device as defined in claim 4 further including a plurality of substantially transparent imprinting elements selectively removably affixed to one of said top and bottom surfaces.

6. A stamping device comprising:

(a) a substantially transparent, solid plastic mounting block having a smooth convex top surface, a smooth generally planar bottom surface and spaced-apart sides, and (b) a plurality of transparent integrally formed imprinting elements removably affixed to said bottom surface, each said imprinting element being formed of a viscoelastic photopolymer and having an upper surface and a lower surface, said lower surface having upstanding ink receiving portions viewable through said convex top surface of said mounting block whereby said ink receiving portions will be magnified and said upper surface having a multiplicity of small gripping protuberances for gripping said smooth surfaces of said mounting block.

7. The device as defined in claim 6 in which said spaced-apart sides include finger gripping portions.

* * * * *